US005387076A

United States Patent [19]

Fuzzen

[11] Patent Number: 5,387,076

[45] Date of Patent: Feb. 7, 1995

[54] STRUCTURE FOR ATTACHING A LOADER TO A TRACTOR

[75] Inventor: Daniel R. Fuzzen, Welland, Canada

[73] Assignee: Deere & Company, Moline, Ill.

[21] Appl. No.: 110,443

[22] Filed: Aug. 23, 1993

[51] Int. Cl.[6] ..... B66C 23/36

[52] U.S. Cl. ..... 414/686; 172/275

[58] Field of Search ..... 414/686, 723, 680; 172/272–275; 37/468

[56] References Cited

U.S. PATENT DOCUMENTS

| | | | |
|---|---|---|---|
| 4,720,233 | 1/1988 | Meyer et al. | 414/686 |
| 4,793,764 | 12/1988 | Hamm | 414/686 |
| 4,802,814 | 2/1989 | Kourogi et al. | 414/686 |
| 4,936,737 | 6/1990 | Rae et al. | 414/686 |

*Primary Examiner*—Donald W. Underwood

[57] ABSTRACT

A loader includes a pair of rear supports projecting transversely outwardly from a longitudinally extending tractor frame. The rear supports are square in cross section. The loader further includes a pair of posts having receptacles at the bottoms thereof which are received about the rear supports when the posts are in upright dispositions, the receptacles, as viewed from the side, being delimited by front and rear contact surfaces that are engaged with locations below and closer together than a major dimension of the associated support so as to secure the posts to the support. When a latch at the front of the loader is released for permitting removal of the loader, lift cylinders of the loader may be operated to cause the posts to swing forwardly and to be lifted away from an associated support once the receptacles are in positions permitting such movement.

6 Claims, 2 Drawing Sheets

STRUCTURE FOR ATTACHING A LOADER TO A TRACTOR

BACKGROUND OF THE INVENTION

The present invention relates to a tractor-mounted loader and more particularly relates to structure for attaching or detaching the masts of a front-mounted loader to or from the tractor.

Designers have spent a lot of effort trying to come up with designs which permit a loader to be easily attached to, or detached from, a tractor. As considered when mounted on a tractor, these loaders typically include a pair of spaced apart, upright masts or standards respectively having lower ends coupled to frame members extending outwardly from the tractor frame. The rear ends of a pair of loader arms are pivotally attached to upper ends of the masts and a pair of boom cylinders are coupled between the masts and the arms for raising and lowering the arms relative to the tractor. A u-shaped brace structure has a pair of legs respectively rigidly attached to the masts at locations below the upper ends thereof and joined together by a transverse bight portion extending ahead of and releasably coupled to a forward end of the tractor. It is the connections between the bottom ends of the masts and the tractor-mounted frame members and between the bight portion of the brace and the front end of the tractor that designers have been trying to simplify. However, attachment of the masts to framework carried by the tractor often involves one or more of bolts, pins, rotatable latches or wedges. These parts often require tools for their installation and/or adjustment so that they properly effect a reliable connection U.S. Pat. No. 4,720,233 granted to Meyer et al on 19 Jan. 1988, U.S. Pat. No. 4,793,764 granted to Hamm on 27 Dec. 1988 and U.S. Pat. No. 4,936,737 granted to Rae et al on 26 June 1990 exemplify the prior art.

SUMMARY OF THE INVENTION

The present invention relates to structure for mounting a loader to a tractor, and more specifically relates to an improved structure for mounting a pair of loader masts to a tractor.

An object of the invention is to provide a structure for mounting a pair of loader masts to a tractor without requiring the use of tools or fasteners.

A more specific object of the invention is to provide a mounting structure, as set forth in the previous object, wherein the lower ends of the loader masts are provided with downwardly opening receptacles shaped for permitting them to be moved onto respective frame members, extending outwardly from opposite sides of the tractor, when the masts are tilted forwardly and for becoming secured to the frame members upon the loader masts being rotated to upright working positions.

Yet a more specific object of the invention is to provide the tractor with square tubular frame members extending horizontally outwardly from opposite sides of the tractor and to provide receptacles on the bottom ends of the masts shaped for engaging locations on three sides of a respective frame member, when the masts are tilted forwardly, and for moving about the frame member so as to extend beyond diagonal corners of the frame member so as to be secured thereto when the mast is rotated to an upright position.

These and other objects of the invention will become apparent from a reading of the ensuing description together with the appended drawings.

DESCRIPTION OF THE PREFERRED EMBODIMENT

Figure 1:
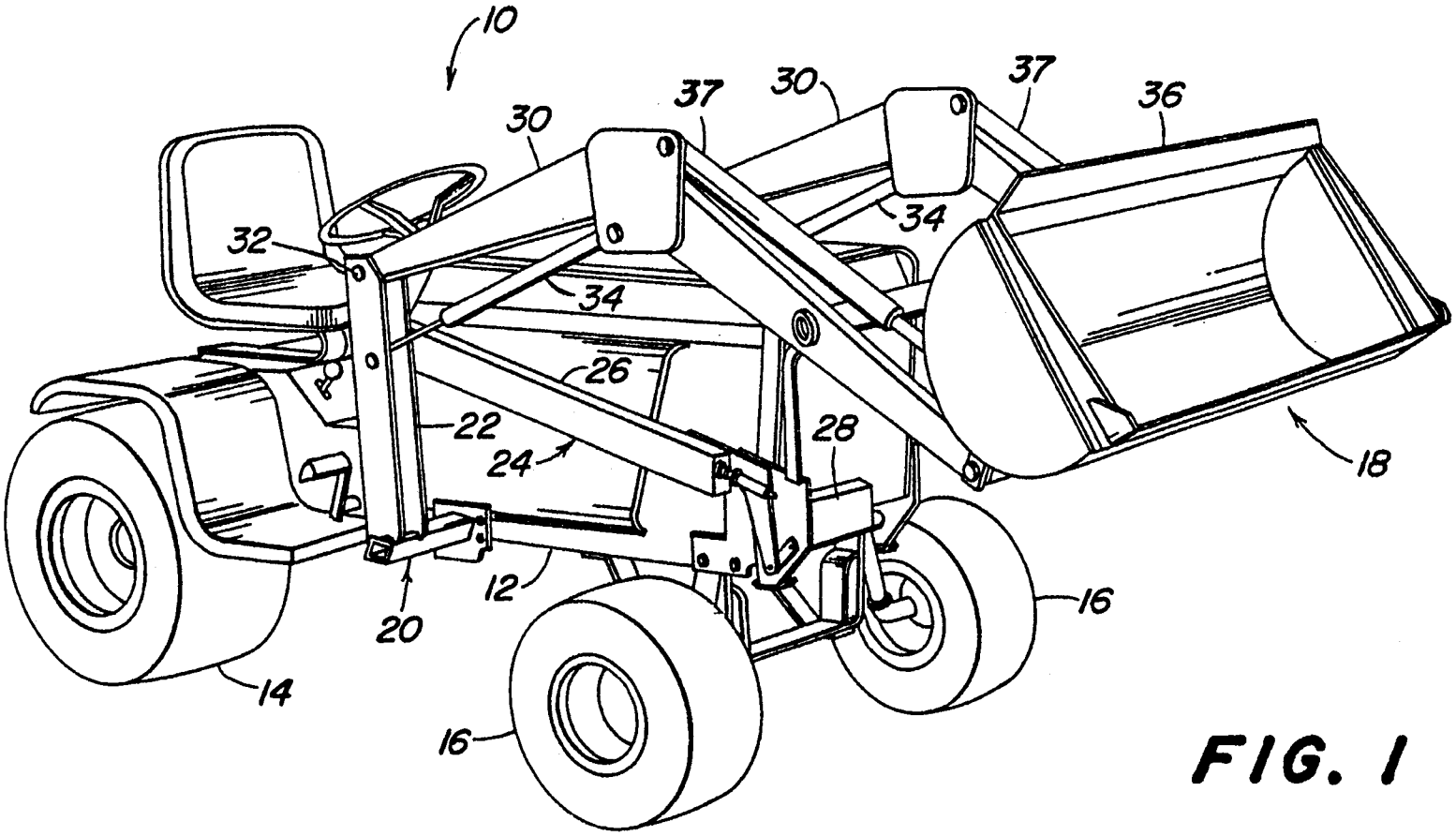
FIG. 1 is a right front perspective view of a tractor with the loader of the present invention attached thereto.

Referring to FIG. 1, there is shown a tractor 10 having a main frame 12 supported for movement over the ground by a pair of rear drive wheels 14 and a pair of front wheels 16. A loader 18 is coupled to horizontal, transverse rear supports 20 coupled or joined to and projecting from opposite sides of the frame 12, and is coupled to a weight bracket or other structure, not visible located at the forward end of the frame 12.

Specifically, the loader 18 is symmetrical about a fore-and-aft centerline and includes a pair of upright masts or posts 22 (only the right mast being visible) respectively located at opposite sides of the tractor with the lower ends of the posts 22 being releasably secured to the rear supports 20 in a manner described below in detail. A U-shaped brace 24 has legs 26 disposed along opposite sides of the tractor 10 with rear ends of the legs 26 being respectively fixed to the masts 22 at inside locations spaced downwardly from the tops of the masts, and with forward ends of the legs 26 being joined together by a bight portion formed by an integrated parking stand and releasable latch structure 28 which is releasably secured to a weight bracket or other structure fixed to or forming an integral part of the tractor frame 12. A loader boom includes a pair of loader arms 30 that are respectively in fore-and-aft alignment with the masts 22 and have rear ends pivotally mounted, as at 32, to upper ends of the masts for vertical movement. A pair of boom cylinders 34 are each coupled between one of the masts 22 and an adjacent one of the arms 30 and are selectively extensible and retractable in concert for raising and lowering the arms about their respective pivot connections 32. Pivotally mounted to the forward ends of the arms 30 is a bucket 36 and a pair of bucket cylinders 37 are each coupled between one of the arms 30 and the bucket 36.

Figure 3:
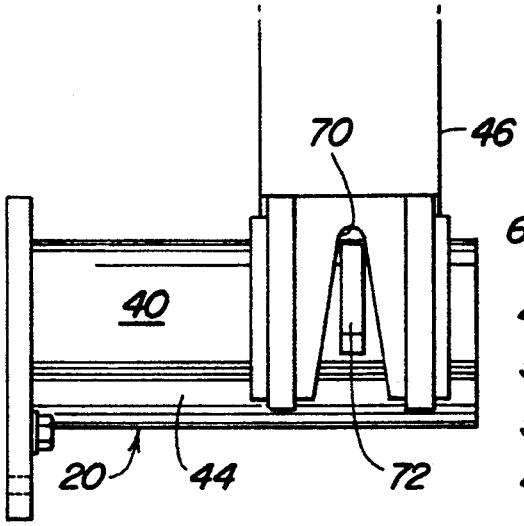
FIG. 3 a rear view of the frame member and mast shown in FIG. 2.
Figure 2:
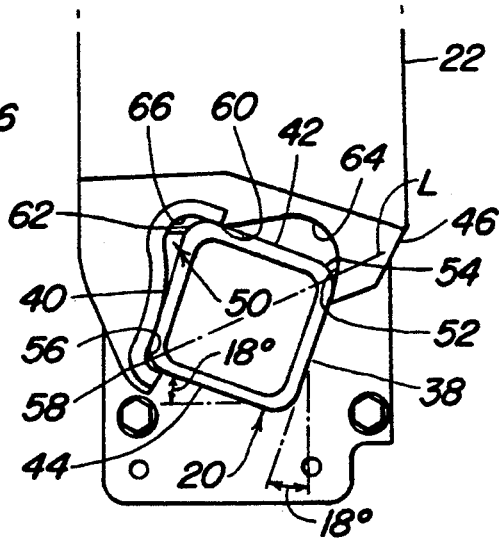
FIG. 2 is a right side elevational view showing the connection between the lower end of the right hand mast and the square tubular frame member that is adapted for being fixed in outwardly projecting relationship from the tractor frame.
Figure 4:
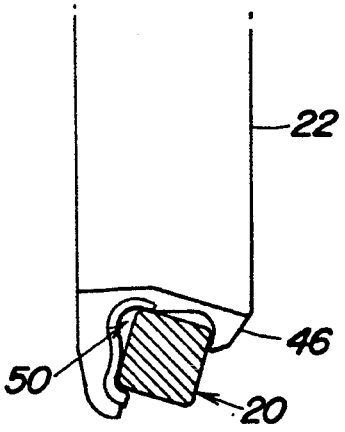
FIGS. 4–6 are right side elevational views showing the mast progressively rotated forwardly about the tubular frame member from an upright mounted position to a detached position.
Figure 5:
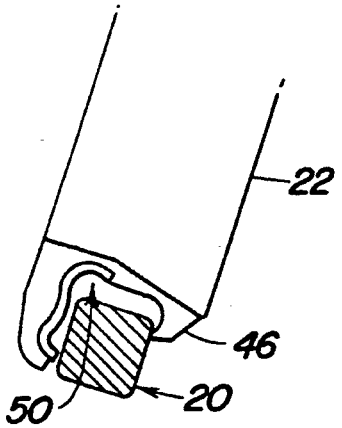
Figure 6:
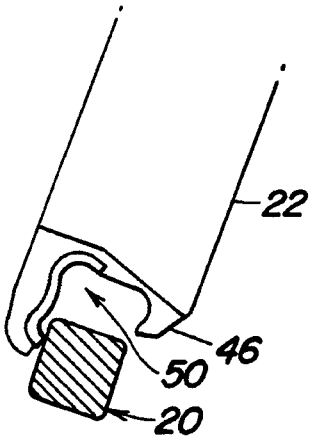

The present invention resides in the way the masts 22 are coupled to the rear supports 20. Specifically, with reference to FIGS. 2 and 3, it can be seen that the supports 20 are constructed of tubes that are square in cross section, with each tube being oriented such that parallel front and rear surfaces 38 and 40 make an angle of about 18° with the vertical, while parallel top and bottom surfaces 42 and 44 make an angle of about 18° with the horizontal. Stated otherwise, the square tubes of each support 20 is oriented such that its cross section has a major dimension lying along a fore-and-aft extending line L inclined upwardly from a rear to a front corner location of the cross section. Each of the masts 22 is formed of a forwardly opening channel member and welded to the bottom of each channel member is a casting forming a mounting member 46 provided with a downwardly opening receptacle 50 shaped so as to retain the masts on the supports 20. Delimiting the entrance to each of the receptacles 50, as viewed in FIG. 2, is a front contact surface 52 engaged with the front surface 38 of the support 20 at a location just below an upper front corner 54 formed by the intersection of the front and the top surfaces 38 and 42, and a rear contact surface 56 extending about and embracing a lower rear corner 58 and adjacent portions of the rear and bottom surfaces 40 and 44 forming the corner 58. It is here noted that the distance between the front and rear contact surfaces 52 and 56 of the receptacle 50 at their areas of engagement with the support surfaces 38 and 44 is less than the distance between the upper front and lower rear corners 54 and 58, respectively, of the rear support 20 and that the line L is above such areas. Thus, the posts 22 are prevented from coming off the supports 20. Each receptacle 50 includes an intermediate contact surface 60 engaged with the support 20 at a location just ahead of an upper rear corner 62 formed by the intersection of the top and rear surfaces 42 and 40, respectively. The receptacles 50 are each provided with gaps or relief areas located between the contact surfaces of the receptacle and spaced from the supports 20 for permitting the posts 22 to be tilted forwardly and lifted away from the supports 20 when detaching the loader 18 from the tractor 10, in a manner described below in more detail. Specifically, each receptacle 50 includes a forward arcuate relief surface 64 which extends between the forward and intermediate contact surfaces 52 and 60, respectively and a rearward arcuate relief surface 66 which extends between the intermediate and rear contact surfaces 60 and 56. As can be seen in FIG. 3, an inverted or downwardly opening, V-shaped centering notch 70 is formed in a rear wall of the each of the mast mounting members 46 and a centering key or projection 72 is fixed to the rear surface 40 of the associated support 20 and located in the top of the notch.

The procedure of detaching the masts 22 from the supports 20 is now described with reference to FIGS. 2 and 4 through 6. Beginning with the loader 18 mounted on the tractor 10, as shown in FIG. 1, the masts 22 will each be in an upright disposition with the supports 20 located in the receptacles 50 and prevented from escape therefrom due to the engagement by the front and rear contact surfaces 52 and 56, respectively, at locations which are below and thus closer together than the diagonal distance between the upper front an lower corners 54 and 58 of the support 20.

When it is desired to detach the loader 18 from the tractor 10, the lift cylinders 34 are actuated to lower the arms 30 to place the bucket 18 on the ground. The latch of the combined latch and parking stand structure 28 is then released from the tractor-mounted support member and the cylinders 34 extended to rock the U-shaped brace 26, together with the posts 22, about the supports 20 so as to bring the structure 28 into contact with the ground. As the masts 22 rock forwardly, the receptacles 50 sequentially go through the positions shown in FIGS. 4, 5 and 6 so that the contact surfaces 52 and 56 move about the supports 20 to the point, shown in FIG. 6, from where they are lifted freely away from the supports through further extension of the cylinders 34. When the mounting portions 46 of the masts 22 are sufficiently high to clear the tires of the front wheels 16, the loader hydraulics are disconnected and the tractor backed free of the loader. The loader is then supported on the brace structure 26 and the bucket 36. If desired, the lift cylinders 34 may be actuated to lower the posts 22 into ground-engaging positions.

To attach the loader, the steps above are reversed. However, when the receptacles 50 are lowered into engagement with the respective supports 20, the centering keys 72 will act in conjunction with the inverted V-shape notches 70 to guide the posts 20 to the desired location along the supports 20.

It will be appreciated that detachment and attachment of the posts 22 of the loader 10 from and to the supports 20 may be done without requiring any tools or adjustment of any kind. Also, while the receptacles 50 are shaped specifically for tool-free attachment to supports that are square in cross section and this is the preferred shape for relative ease in the manufacture thereof, it is to be understood that the receptacles and the supports could be other compatible shapes. For example, the receptacle could be substantially C-shaped with the supports having an oval cross section and being oriented such that contact surfaces delimiting front and rear ends of the receptacle engage the supports at respective locations below the major axis of the oval cross section so as to secure the masts to the supports.

I claim:

1. In a loader including a pair of transversely spaced upright posts respectively releasably secured to a pair of rear supports carried by and projecting transversely opposite one another from a longitudinally extending tractor frame, the improvement comprising: each of said supports having a cross section including a major dimension lying along a fore-and-aft extending line inclined upwardly from a rear to a front location of the cross section; said posts each having a downwardly opening receptacle at the lower end thereof delimited, as viewed from the side, by front and rear contact surfaces engaged with respective surfaces of an associated one of the rear supports at respective locations below said fore-and-aft extending line; and the distance between said front and rear contact surfaces being less than said major dimension, whereby the contact surfaces of a given receptacle act to secure the associated post to an associated one of the supports.

2. The loader defined in claim 1 wherein said receptacles, as viewed from the rear, have an inverted, V-shaped centering notch formed in a rear wall thereof; and each support having a centering key protruding rearwardly therefrom and located in an upper location of the notch, whereby during attaching the loader posts to the supports the notches will engage an adjacent one of the centering keys so that the receptacles are guided for engaging a desired location along the length of the associated support.

3. The loader defined in claim 1 wherein said supports are square in cross section with said major dimension being the distance between an upper front and a lower rear corner of each of the supports.

4. The loader defined in claim 3 wherein said supports include a front surface inclined downwardly and rearwardly at an angle of about 18° from the vertical.

5. The loader defined in claim 3 wherein said receptacle includes an intermediate contact surface in engagement with an associated one of the supports at a location just ahead of an upper rear corner of thereof.

6. The loader defined in claim 2 wherein said supports are square in cross section and each centering key being fixed to and projecting rearwardly from a rear surface of an associated one of the supports.

* * * * *